US005332646A

United States Patent [19]

Wright et al.

[11] Patent Number: 5,332,646

[45] Date of Patent: Jul. 26, 1994

[54] METHOD OF MAKING A COLLOIDAL PALLADIUM AND/OR PLATINUM METAL DISPERSION

[75] Inventors: Robin E. Wright, Dakota; Hsin H. Chou, Woodbury, both of Minn.

[73] Assignee: Minnesota Mining and Manufacturing Company, St. Paul, Minn.

[21] Appl. No.: 964,450

[22] Filed: Oct. 21, 1992

[51] Int. Cl.[5] ..... G03G 5/00; G03C 1/52

[52] U.S. Cl. ..... 430/137; 430/197; 430/32; 430/114; 427/304

[58] Field of Search ..... 430/197, 137, 32, 114; 204/180.1, 180.3

[56] References Cited

U.S. PATENT DOCUMENTS

| | | | |
|---|---|---|---|
| 4,252,677 | 2/1981 | Smith | 252/430 |
| 4,892,798 | 1/1990 | Lamanna et al. | 430/38 |
| 4,985,321 | 1/1991 | Chou et al. | 430/38 |
| 5,089,362 | 2/1992 | Chou et al. | 430/16 |

OTHER PUBLICATIONS

Esumi, K., Tano, T., and Meguro, K., *Preparation of Organopalladium Particles from Thermal Decomposition of Its Organic Complex in Organic Solvents,* 5 Langmuir 268-270 (1989).

Gross,. M. E., Appelbaum, A., and Gallagher, P. K., *Laser Direct-Write Metallization in Thin Palladium Acetate Films,* 61(4) J. Appl. Phys. (Feb. 15, 1987).

Hirai, H., Chawanya, H., and Toshima, N., *Colloidal Palladium Protected with Poly(N-Vinyl-2-Pyrrolidone) for Selective Hydrogenation of Cyclopentadiene,* Dept. of Indust. Chem., Faculty of Eng., The University of Tokyo, Hongo, Bunkyo-ku, Tokyo 113.

Meguro, K., Torizuka, M., and Esumi, K., *The Preparation of Organo Colloidal Precious Metal Particles,* 5 Langmuir 268 (1989).

Nakao, Y. and Kaeriyama, K., *Preparation of Noble Metal Sols in the Presence of Surfactants and Their Properties,* 110 (1) Journal of Colloid and Interface Science (Mar. 1986).

*Preparation of Organopalladium Sols by Thermal Decomposition of Palladium Acetate,* 133(2) Journal of Colloid and Interface Science (Dec. 1989).

Satoh, N., and Kimura, K., 62 Bull Chem. Soc. Jpn., 1758 (1989).

Savinova, E. R., Chuvilin, A. L., and Parmon, V. N., *Copper Colloids Stabilized by Water-Soluble Polymers Part I. Preparation and Properties,* 48 Journal of Molecular Catalysis 217-229 (1988).

Sequoia, E., S. A., *The Electrochemical Reduction of Perezone in the Presence of Benzoic Acid in Acetonitrile,* 310 J. Electroanal. Chem. 293-303, (1991).

Stephenson, T. A., Morehouse, S. M., Powell, A. R., Heffer, J. P., and Wilkinson, G., *Carboxylates of Palladium, Platinum, and Rhodium, and their Aadducts,* J. Chem. Soc. 3632 (1965)

*Primary Examiner*—John Kight, III
*Assistant Examiner*—Richard Jones
*Attorney, Agent, or Firm*—Gary L. Griswold; Walter N. Kirn; Karl G. Hanson

[57] ABSTRACT

A method of making a colloidal metal dispersion that is useful as a toner fluid. The method involves reducing a palladium and/or platinum metal of a metallo-organic palladium and/or platinum metal salt in a dispersing medium that contains a soluble surfactant and a carrier liquid. The palladium and/or platinum metal of the metallo-organic metal salt is reduced in the dispersing medium to form elemental metal particles. The soluble surfactant is present in the dispersing medium in an amount sufficient to charge and stabilize the elemental metal particles as a colloidal metal dispersion.

27 Claims, No Drawings

METHOD OF MAKING A COLLOIDAL PALLADIUM AND/OR PLATINUM METAL DISPERSION

TECHNICAL FIELD

This invention pertains to a method of making a colloidal, palladium and/or platinum metal dispersion, and more particularly to a metal dispersion that is useful as a metallic toner fluid composition. This invention also pertains to methods of making and transferring metallic coatings.

BACKGROUND OF THE INVENTION

Metallic toner fluid compositions are known in the toner fluid art. U.S. Pat. Nos. 5,089,362, 4,985,321 and 4,892,798 disclose metallic toner fluid compositions and their use in making metallic coatings. The metallic toner fluid compositions contain colloidal, elemental metal particles dispersed in nonpolar organic carrier liquids. Surfactants are employed in the nonpolar carrier liquids to charge and stabilize the colloidal metal dispersions. These patents disclose that the metallic toner fluid compositions can be prepared using a gas evaporation reactor (GER), a Klabunde-style static reactor, or a Torrovap TM rotary reactor (Torrovap Industries, Markam, Ontario, Canada). The GER is disclosed as being the preferred reactor for making colloidal metal dispersions. Although these reactors may be suitable for making colloidal metal dispersions, each of these reactors, including the preferred GER, provide difficult and mechanically-complicated ways of generating metallic particles for toner fluids.

For example, the GER generates metal particles from bulk metal under very stringent operating conditions. The metal is heated in a furnace chamber to a temperature that can be in excess of 1000° C. under a relatively low vacuum. The metal particles that form from this heating are carried from the furnace chamber to the carrier liquid by an inert gas. Frequently, vacuum leaks occur in the GER, causing an increase in particle size an oxidation of the metal particles (when oxidizable metals are used). In addition, it is very difficult, if not impossible, to generate small metal particles at a fast rate; thereby making a commercialized process impractical. Large metal particles are not as suitable for use in a metallic toner fluid composition because the dispersions tend to be less stable, and when the large particles are deposited on a substrate they provide low image resolutions. High resolutions are needed to make good graphic images.

U.S. Pat. No. 4,252,677 discloses a method of preparing a dispersion of colloidal nickel, palladium, or platinum metal particles in the size range of about 10 to 200 Angstroms. The method comprises preparing a solution of a functional polymer in an inert solvent, and incrementally adding thereto an organometallic metal precursor containing nickel, palladium, or platinum. The temperature of the solution is sufficiently high to decompose the organometallic metal precursor to yield colloidal metal particles. The only palladium and platinum organometallic metal precursors that are disclosed in this patent are dichloroplatinumdicarbonyl and dipalladiumchlorodicarbonyl. These organometallic metal precursors have the carbon atom bound directly to the metal atom and contain neutral carbonyl functionality, and therefore require an anionic species, in this case, chloride, to balance the positive charge of the metal.

Chloride, however, as a negatively-charged species, may have a deleterious effect on the stability of the dispersion, and hence its use as a toner fluid. Further, the organometallic palladium and platinum salts disclosed in U.S. Pat. No. 4,252,677 are not commercially available and are very difficult to prepare. For example, the preparation of the dipalladiumchlorodicarbonyl starting material calls for the use of perezone, a quinone-type natural product extracted from certain varieties of the Perezia root. See Garcia et al., *Structure of Di-μ-chlorobis(dicarbonylpalladium)*, C43 Acta, Cryst. 1679–81 (1987); Gonzalez et al., *The Electrochemical Reduction of Perezone in the Presence of Benzoic Acid in Acetonitrile*, 310 J. Electronic Chem. 293–303 (1991); and Garcia et al., *Perezone and Related Sesquiterpenes from Parvifoline*, 50 J. Nat. Prods, 1055–1058 (November–December 1987).

SUMMARY OF THE INVENTION

The present invention provides a new method of making a palladium and/or platinum colloidal metal dispersion. The method comprises reducing a metallo-organic palladium and/or platinum metal salt in a dispersing medium that comprises an organic carrier liquid and a soluble surfactant. The palladium and/or platinum metal of the metallo-organic metal salt is reduced in the dispersing medium to form elemental metal particles. The soluble surfactant is present in the dispersing medium in an amount sufficient to charge and stabilize the elemental palladium and/or platinum metal particles as a colloidal dispersion.

This method is advantageous in that: (i) it provides a colloidal metal dispersion under mild conditions; (ii) it allows the concentration of metal particles to be more easily controlled; (iii) it permits a colloidal metal dispersion to be made without employing expensive equipment; (iv) it employs metallo-organic metal salts, which unlike the previously-disclosed organometallic compounds, are readily available and unlikely to have deleterious effects on the use of the resulting metal dispersion as a toner fluid; and (v) it is more practical for commercial scale up.

Colloidal metal particles produced by the method of this invention can be electrophoretically-deposited on a primary receiving substrate to make a nonconductive metallic coating. Electrophoretic deposition is a process where dispersed, charged pigment particles migrate to and deposit upon a surface under the influence of an electric field. The non-conductive metallic coating or a portion thereof can be transferred from the primary receiving substrate to a secondary receiving substrate. Before or after this transfer, the metallic coating can be contacted with an electroless metal plating solution to form a metal plating thereon. Articles that bear an electrophoretically-deposited metallic coating can be used in catalysis. Electroless plating is an example of a catalytic application for metallic coatings, and an electroless plated article may be useful in electronics as a circuit or in graphic arts as a metallic image.

GLOSSARY

As used herein:

"electrically conductive", when referring to metallic coatings, means that the conductivity of the coatings is greater than $10^3$ (ohm-cm)$^{-1}$;

"electrically nonconductive", when referring to metallic coatings, means that the conductivity of the coatings is less than or equal to $10^3$ (ohm-cm)$^{-1}$;

"metallic coating" means a continuous, discontinuous, imagewise, or other pattern or layer of a metal on a substrate;

"metallo-organic" means a coordination compound in which at least one ligand contains a hydrocarbon moiety that is coordinated to the metal through a heteroatom (O, S, N, P, etc.);

"primary receiving substrate" means a substrate surface to which a metallic coating is applied;

"secondary receiving substrate" means a substrate onto which a metallic coating is transferred from a primary receiving substrate;

"soluble surfactant" means at least 1 milligram (mg) of surfactant dissolves in 100 milliliters (ml) of the chosen organic carrier liquid;

"stable or stabilized" means that no more than 10 percent of the particles in a colloidal dispersion settle over a period of 1 week under ambient conditions of 25° C. and 1 atmosphere pressure (760 Torr);

"surfactant" means a surface active agent or dispersing agent or charge control agent which interacts with the surface of the colloidal metal particles to provide electrostatic charge to the particles making the toner fluid stable;

"toner fluid" means a dispersion of charged particles in a fluid medium which dispersion responds to an electrostatic field in such a way as to make it useful in electrophoretic coating and imaging.

DETAILED DESCRIPTION OF PREFERRED EMBODIMENTS OF THE INVENTION

Preparing a Colloidal Metal Dispersion

In the practice of this invention, a colloidal metal dispersion is made by a process that comprises reducing a metallo-organic palladium and/or platinum metal salt in a dispersing medium that comprises an organic carrier liquid and a surfactant. The dispersing medium preferably has a volume resistivity of greater than about $10^9$ ohm-cm, more preferably greater than $10^{10}$ ohm-cm. In pure form, the organic carrier liquid preferably has a volume resistivity of greater than about $10^{12}$ ohm-cm, preferably greater than $10^{13}$ ohm-cm, and more preferably greater than $10^{14}$ ohm-cm, and preferably has a dielectric constant less than 3.5, more preferably less than 2.5 (at 25° C. and 1 kilohertz ($kH_z$)). The metallo-organic palladium and/or platinum metal salt preferably is soluble in the dispersing medium. The term "soluble" is used here to means that at least 1 milligram (mg) of the metal salt dissolves in 100 milliliters (ml) of the dispersing medium at a temperature below the onset of reduction of the metal salt by a primary reducing agent. A "primary reducing agent" is a ligand of the metallo-organic palladium and/or platinum metal salt which is capable of reducing the metal to its elemental form at elevated temperatures (that is, above room temperature (25° C.)). A "secondary reducing agent" is a reducing agent other than a primary reducing agent. The metal salt is reduced to its elemental form to produce colloidal metal particles having sizes that typically range from about 1 to 250 nanometers (nm), preferably 1 to 100 nm, more preferably 2 to 50 nm. The term "elemental" means that the metal particles consist essentially of pure palladium metal, pure platinum metal, or combinations thereof.

Reduction of palladium and/or platinum in the metallo-organic metal salts can be accomplished by employing a primary or secondary reducing agent in the dispersing medium. As a primary reducing agent, the palladium and/or platinum metal salts preferably contain an anionic ligand that is coordinated to the metal atom of the metal salt by a heteroatom and is capable of reducing the metal to its elemental form when the dispersing medium is heated. Examples of anionic ligands that the palladium and/or platinum metal salts may contain as a primary reducing agent include carboxylic acid derivatives and diketonates.

Examples of metallo-organic palladium and platinum metal salts that may be useful in this invention include (but are not limited to) palladium and platinum alkyl or aryl carboxylates such as palladium(II) acetate ($Pd(OAc)_2$), palladium(II) formate, palladium(II) propionate, palladium(II) fumarate, palladium(II) stearate, palladium(II) benzoate, diacetatobis (triphenylphosphine) palladium(II), platinum (II) acetate ($Pt(OAc)_2$), platinum(II) formate, platinum(II) propionate, platinum(II) fumarate, platinum(II) stearate, platinum(II) benzoate, and diketonates such as palladium(II) 2,4-pentanedionate ($Pd(acac)_2$), palladium(II) 1,1,1,5,5,5,-hexafluoro 2,4-pentanedionate, platinum(II) 2,4-pentanedionate ($Pt(acac)_2$), and platinum(II) 2,4-octanedionate. Preferred metallo-organic metal salts include $Pd(OAc)_2$, $Pt(OAc)_2$, $Pd(acac)_2$, and $Pt(acac)_2$. Preferred metallo-organic metal salts lack carbonyl and halogen functionality. The metallo-organic palladium and/or platinum metal salts typically are introduced into the dispersing medium at amounts ranging from about 0.001 to 2 weight percent, more preferably from 0.005 to 1 weight percent, based on the weight of the dispersing medium.

In addition to a primary reducing agent, a secondary reducing agent can be employed to assist in the reduction of the palladium and/or platinum metal. A secondary reducing agent is desired when the metal salt's ligands cannot function as a primary reducing agent or the primary reducing agent only produces a slow reduction of the metal to its elemental state. When the palladium and/or platinum metal cation is readily reduced by the primary reducing agent, the use of a secondary reducing agent should be avoided because reduction may occur so swiftly that the resulting elemental particles are too large. Secondary reducing agents may include, for example, sodium borohydride, lithium aluminum hydride, sodium hydride, hydrazine, and hydrogen gas. Hydrogen gas is a preferred secondary reducing agent because it contains no ionic species and is relatively inexpensive. The presence of extraneous ions may interfere with the stability of the resulting dispersion, and may reduce its volume resistivity to thereby have a deleterious effect on its use as a toner fluid. The amount of secondary reducing agent may vary with, for example, the ease of reduction of the metal salt, the ligands of the metal salt, and the temperature of the dispersing medium. When hydrogen gas is used as a secondary reducing agent, it can be bubbled into the dispersing medium to promote the reduction of the metal cation.

Reducing of the palladium and/or platinum to its elemental metal state can also be promoted by heating the dispersing medium containing the metal salt. In some embodiments of the invention, the dispersing medium preferably is heated to a temperature less than the boiling point of the carrier liquid. The preferred temperature of the dispersing medium is a function of the specific primary reducing agent and the ease of reduction of the palladium and/or platinum metal cation. If the metal cation is easily reduced, a high solution temperature can cause reduction to occur so quickly that the resulting elemental particles may flocculate. Therefore care should be taken when heating the dispersing medium to promote reduction of the metal cation. When using metal salts such as $Pd(OAc)_2$, $Pt(OAc)_2$, $Pd(acac)_2$, or $Pt(acac)_2$, it has been found that a temperature in the range of 100° to 150° C. can promote reduction of the metal.

The resulting colloidal elemental metal-particles preferably have a metal core that is more than 99 weight percent pure metal, more preferably more than 99.5 weight percent pure metal. The metal core is usually crystalline, but may be amorphous depending upon the conditions used in its preparation.

The elemental metal core may be surrounded by a thin surface coating of metal oxide or metal salt formed by surface oxidation of the elemental metal in air or by a component of the liquid medium. When present, the metal oxide or salt coating can account for less than 20 mole percent, preferably less than 10 mole percent, more preferably less than 5 mole percent, of the total metal content (metal plus metal oxide or salt). In many cases, the particles are essentially free of any oxide or metal salt coating.

A chemically bonded or physically absorbed surfactant can form an extreme outer layer on the particles. Such a layer is generally associated with (that is, chemically or physically adsorbed onto) the metal particles of this invention. The surfactant layer serves to charge the palladium and/or platinum metal particles in the dispersion, and may also sterically stabilize the dispersion to impede flocculation. The surfactant and oxide or salt layers may be continuous or non-continuous, but preferably is non-continuous when the metallic coating is to be plated by a catalytic method such as electroless plating.

There can be limits on the amount of metal particles in the resulting dispersions. The content of the metal particles depends on surfactant concentration in the organic carrier liquid. Limitations exist because, at high metal concentrations, the dispersions may exhibit instability in the form of particle aggregation or flocculation. At low surfactant concentrations (0.01 to 1.0 g/100 ml of carrier liquid), metal loadings up to 1.0% by weight in the organic carrier liquid, preferably in the range of 0.001 to 0.1% by weight, may be achieved without appreciable flocculation of the dispersion. It is preferred that the metal particles' number average particle size in a dispersion increase by at most a factor of 5 (more preferably 2) over a three month period at 25° C. and one atmosphere.

The colloidal metal dispersion may be comprised of a single metal or a combination of palladium and platinum. Mixed metal compositions may be produced by having both palladium and platinum metallo-organic metal salts present in the same dispersing medium. Thus, the resulting toner fluid can contain palladium "and/or" platinum colloidal metal particles. The term "and/or" has been used herein for simplicity sake to indicate that the metals of palladium metallo-organic metal salts and platinum metallo-organic metal salts may be reduced individually or in combination to produce a palladium metal dispersion, a platinum metal dispersion, or dispersion that contains both palladium metal particles and platinum metal particles or particles that contain combinations of these metals.

Carrier liquids suitable for use in the dispersing medium include nonpolar organic liquids capable of dispersing the colloidal metal particles. Preferred carrier liquids also have melting points not exceeding 15° C., boiling points at from 60° to 300° C. at 1 atmosphere pressure, and viscosities of less than 5 centipoise at 25° C.

Classes of liquid media that may be suitable as carrier liquids include (but are not limited to): straight-chain, branched-chain, and cyclo-aliphatic hydrocarbons such as petroleum oils, naphtha, ligroin, hexane, pentane, heptane, octane, isododecane, isononane and cyclohexane; aromatic hydrocarbons such as benzene, toluene and xylene; and halocarbon liquids such as 1,1,2-trichloro-1,2,2-trifluoroethane, trichloromonofluoromethane and carbon tetrachloride. Organic carrier liquids particularly useful for preparing toner fluid dispersions of this invention are the isoparaffinic hydrocarbons Isopar TM G (boiling point of 156°-176° C.) and Isopar TM M (boiling point of 207°-254° C.) (Exxon Company USA, Houston, Tex.). The Isopar TM G and M carrier liquids have been found to be particularly suitable because they tend to possess high purity, high volume resistivity, low dielectric constant, low viscosity, and convenient boiling range.

Soluble surfactants useful in the dispersing medium are those that are capable of stabilizing the metal dispersion. Examples of preferred surfactants useful for this invention include fluorocarbon surfactants such as Fluorad TM FC-740, a fluorinated alkyl ester available from 3M, St. Paul, Minn.; epoxide terminated polyisobutylenes including Actipol TM E6, E16, and E23 available from Amoco Chemical Co., Chicago, Ill.; commercial oil additives such as Lubrizol TM 6401 and Lubrizol TM 6418 available from The Lubrizol Corporation, Wickliffe, Ohio, Amoco TM 9250 available from Amoco Petroleum Additives Company, Naperville, Ill., and OLOA TM 1200 available from Chevron Chemical Company, San Francisco, Calif.; and hydrocarbon compatible hyperdispersants such as Solsperse TM 17,000 available from ICI Americas Inc., Wilmington, Del. The more preferred surfactants are OLOA TM 1200, a low molecular weight polyisobutylene attached to a diamine head group by a succinimide linkage, and the fluorocarbon surfactants. Usually, the surfactant will have a molecular weight of less than about 20,000, more typically less than about 10,000.

Although the above surfactants are preferred for use in this invention, it is within the scope of this invention to select other surfactant compositions, including compositions known to be effective as charge control agents in prior art toner fluid dispersions. Such surfactant compositions include natural and synthetic materials and combinations thereof, which can be neutral or ionic. Natural materials include triglycerides such as linseed oil and soybean oil, and fatty acids such as linoleic acid, linolenic acid, oleic acid, and their combinations. Synthetic surfactants generally provide superior toner fluid stability and performance. Synthetic surfactants include functionalized homopolymers and copolymers of vinyl-containing monomers. Examples of vinyl containing monomers include: N-vinylpyrrolidone, vinyl acetate, styrene, vinyltoluene, vinylpyridine, acrylates and methacrylates; and block, graft or random copolymers such as those having the following monomer combinations: styrenebutadiene, vinylchloride-vinyl ether, methacrylic acid ester-N-vinylpyrrolidone, fatty acid-methacrylate ester, styrene-allyl alcohol and alkylacrylate-styrenebutadiene. Other synthetic surfactants include: polyesters of carboxylic acids (for example, polydecamethylene sebacate, alkyd resins); epoxy resins and phenolic resins (for example, Novolacs TM); functionally terminated homopolymers such as epoxide or amine-terminated polyolefins; ionic surfactants such as copper oleate, Aerosol TM OT (sodium dioctylsulfosuccinate), triisoamylammonium picrate and aluminum octanoate and mixtures or combinations thereof. Other commercially available charge control agents useful in the art are given in R. M. Shaffert, "Electrophotography" pp. 71, 72, *The Focal Press*, New York (1975).

Surfactant concentration in a colloidal metal dispersion can have a dramatic influence on toner fluid performance. Surfactant concentration levels that are too low result in inadequate stability of the toner fluid to flocculation; whereas, high surfactant concentrations can produce high ion concentrations in the toner medium, which reduce the speed and efficiency of the development process. Surfactant concentrations typically are at from about 0.01 to 1.0 g/100 ml.

In addition to a surfactant(s), other components can be added to the carrier liquid. For example, organosol particles or soluble polymers other than surfactants can be employed. U.S. Pat. No. 5,089,362 discloses metallic toner fluids that contain such ingredients.

Electrophoretic Development

The colloidal metal dispersions made by the process of this invention can be used in electrophoretic development. Electrophoretic development of a metallic toner fluid has been disclosed in U.S. Pat. Nos. 5,089,362; 4,985,321; and 4,892,798, the contents of which are incorporated here by reference. As previously indicated, electrophoretic development is a process where dispersed, charged particles of a toner fluid migrate under the influence of an electric field and deposit upon a substrate that is in contact with the toner fluid.

Electrophoretic deposition can be achieved using known electrographic coating and imaging techniques. These techniques generally involve sensitizing or charging the substrate surface by, for example, depositing positive or negative ions generated in a corona discharge, followed by developing charged areas of the substrate by electrostatically attracting oppositely-charged particles of the toner fluid. Alternatively, an external electric field may be applied to drive charged particles of the toner fluid to the substrate surface. A number of variations on these basic processes are known in the art, but all basically rely on mobility of electrostatically-charged toner particles in an electric field to achieve a controlled deposit of particles on the substrate surface.

The metallic coatings produced by electrophoretic deposition may be in the form of, for example, a continuous film covering the entire substrate surface or a patterned image. A patterned image may be produced by selectively charging or discharging the substrate surface to form a latent electrostatic image, which is subsequently developed by an electrophoretic means.

The substrate employed in electrophoretic development may be any of the substrates disclosed in the above-noted patents and therefore need not be discussed here in detail. Briefly, the substrate can be a conductive, photoconductive, or dielectric substrate and may be in the form of thin, 2-dimensional, planar sheet constructions.

Standard electrophotographic equipment can be used for producing colloidal metal coatings and patterned images on a variety of substrates. A particularly useful electrophotographic set-up may consist of the following components: 1) a corona-discharge unit for depositing a charge on a substrate surface; 2) a projection exposure unit for generating a latent electrostatic image on a photoconductive substrate; and 3) an extrusion-type developing station for contacting the charged substrate with toner fluid of the invention and providing controlled colloidal metal deposition on the substrate surface through application of a potential bias.

Colloidal metal particles can be deposited on a photoconductive film construction as described in example 26 of U.S. Pat. No. 4,337,305. The particles may be deposited in the form of high resolution, nonconductive, metallic images. High resolution imaging may be achieved by first charging the entire surface of the photoconductor in a corona discharge. A patterned image may then be obtained by selectively discharging the surface of the photoconductor. This can be accomplished by exposing the surface to an image projected through a high resolution target. After exposure, a latent electrostatic image is formed, which may be developed under a controlled bias potential using a metallic toner fluid dispersion of the invention. The development produces a corresponding metal image.

Metal Plating

Metal plating may be achieved by contacting an electrophetically-deposited metallic coating to an electroless plating solution. Electrophoretically-deposited metal particles of a metallic coating function as catalysts that promote electroless metal plating. The electrophoretically-deposited metal particles are contacted with an electroless metal plating solution for a time sufficient to induce metal plating, typically 0.5 to 30 minutes. Electroless metal plating occurs selectively in areas on the substrate surface where the metal particles have been deposited. The deposited particles induce metal plating in the electroless plating process and the resulting electroless plated metal exhibits electrical conductivity. Electroless platings can have a total thickness of up to about 30 micrometers, preferably (for printed circuit applications) in the range of 0.03 to 20 micrometers. At resolutions of up to 150 line-pairs per millimeter (mm), image enhancement and electrical conductivity may be achieved with negligible resolution loss. Electroplating of the conductive metal films also can be utilized to further enhance the coatings or increase the thickness of the metal in the plated areas.

Electroless plating solutions have been described in the art. These solutions minimally contain a metal salt and a reducing agent in an aqueous or organic medium. In an electroless plating process, the metal in the metal salt is catalytically reduced to its elemental form and is deposited as such. Salts of a variety of metals have been shown to be effective for this purpose. Additionally, combinations of metals also can be electroless plated. Particularly useful electroless plating solutions are aqueous solutions of copper, nickel, or cobalt which are readily prepared or are available from a variety of commercial sources and are described in J. McDermott, *Plating of Plastics with Metals*, pp. 62, 94, and 177, Noyes Data Corporation, Park Ridge, N.J., (1974).

Method of Transferring Deposited Toner Fluid Particles and Metal Platings

Metallic coatings can be transferred from a primary receiving substrate to a secondary receiving substrate. The transfer can be accomplished using thermal mass transfer printing techniques. Thermal mass transfer involves the transfer of a metal by any means involving energy, including electronic or conventional heat and pressure. Heat may be generated in a variety of ways including resistive heating, infrared radiation absorption including laser and microwave energy, and piezoelectric energy. Metallic coatings may be transferred in an imagewise fashion from a primary receiving substrate to a secondary receiving substrate by selectively applying heat and pressure. Metallic coatings to be transferred may include electrophoretically-deposited-metal-particles by themselves and deposited metal particles that have been electrolessly plated with metal. When a metal coating of electrophoretically-deposited-metal-particles is employed, the transferred metal is nonconductive, but can be made conductive by subsequently exposing the coated secondary receiving substrate to an electroless plating solution. The thermal mass transfer and electroless plating steps therefore may be performed in either order.

A number of available thermal printing techniques may be used in a mass transfer metallic imaging process. Thermal mass transfer metallic imaging can be achieved using a digital printer equipped with a thermal-mass-transfer-type-print-head. The benefits of these printers in thermal mass transfer printing applications are described in U.S. Pat. No. 4,839,224. Using such a thermal printer, metallic images are produced by first positioning a metal-coated primary receiving substrate in contact with heating elements of a thermal print-head. A secondary receiving substrate is placed in contact with the primary receiving substrate on the side of the primary receiving substrate opposite to, but essentially colinear with, the heating elements of the thermal print-head. The thermal print-head is activated to supply heat selectively to areas of the primary receiving substrate to cause adhesive bonding of metal to the secondary receiving substrate. Subsequent separation of the primary and secondary substrates results in the transferred metal adhering to the secondary receiving substrate. An optional final radiation or thermal fusion step may be used to further promote adhesion of the metallic images to the secondary receiving substrate.

When image transfer is by use of the thermal-mass-transfer-type-print-head described above, the dimensions and physical properties of the primary receiving substrate are important to the effectiveness of the thermal mass transfer metallic imaging process and the quality of the final metallic images. Preferably, the primary receiving substrate is thin so that it may provide efficient heat transfer to the receptor. Substrate thicknesses are generally less than 15 micrometers, preferably less than 9 micrometers, and more preferably less than 6 micrometers. Furthermore, the primary receiving substrate composition preferably is non-thermoplastic at the temperatures generated by the thermal printer to prevent sticking of the thermal print-head to the primary substrate. It is preferred that the glass transition temperature ($T_g$) of this substrate is generally greater than 80° C., and preferably greater than 120° C. In addition, anti-stick or anti-stat coating may be applied to the substrate to reduce print-head friction. Substrate materials that can be used for this purpose include (but are not limited to): cellophane, and high $T_g$ synthetic resin films such as polyesters, polyamides, polyethylenes, polycarbonates, polystyrenes, polyvinyl acetates, polyvinyl alcohols, and polypropylenes.

Thermal mass transfer can also may be achieved by passing the primary and secondary receiving substrates through a heat/pressure roller system in an overlaying relationship, or the primary and secondary receiving substrates may be exposed to high intensity infrared radiation while being held in intimate contact with each other.

The secondary receiving substrate can be selected from a wide variety of materials and a wide variety of shapes and thicknesses and may be a thermoplastic polymer film or may be comprised of a thermoplastic polymer film on a supporting base. The substrate may be in the form of sheets, films, or solids. The base may include paper, glass, ceramics, metals, wood, fabrics, polymeric materials including thermoplastic, laminates of combinations of these materials, and other materials commonly used as substrates for metal images. Suitable secondary receiving substrates are described in U.S. Pat. Nos. 5,089,362 and 4,985,321.

The thermal energy required to achieve thermal transfer of metallic images depends to a large extent upon the primary and secondary receiving substrates. Typically, it is desired to use a minimum print-head energy to achieve thermal mass transfer because minimum print-head energy prolongs the life of the print-head and also minimizes thermal degradation of the primary substrate. Generally, the print-head is operated at an energy of 1–10 Joules per square centimeter ($J/cm^2$) and preferably at from 1.6 to 2.5 $J/cm^2$.

For direct transfer of conductive metal images, the thickness of the electroless plated metallic coating on the primary receiving substrate is also important: if it is too thin, the metallic coating will not exhibit good electrical conductivity, and if it is too thick, the cohesive strength of the metallic coating will inhibit thermal mass transfer. Electroless metal plated coatings having a thickness of between 0.03–0.1 micrometers, preferably between 0.05–0.08 micrometers, have been found to work well in this process of the invention.

Features and advantages of this invention are further illustrated in the following examples. It is to be expressly understood, however, that while the examples serve this purpose, the particular ingredients and amounts used as well as other conditions and details are not to be construed in a manner that would unduly limit the scope of this invention.

EXAMPLES

Example 1

Preparation of Metallic Toner Fluid

Palladium acetate (3.19 mg) was added to 110 g of Isopar TM G (Exxon Corp., Houston, Tex.) containing 0.04 weight percent OLOA TM 1200 (Chevron Chemical Co.). The mixture was heated to reflux in a 100 ml round bottom flask using a Vigreaux column and slow nitrogen purge. Within approximately 15 minutes, the yellow solution had turned black. Inductively Coupled Plasma (ICP) Spectroscopy showed a palladium concentration of 160 parts per million (ppm). Particle size data using Photon Correlation Spectroscopy (PCS) showed that the mean number average particle size (greater than 1 micrometer) was much larger than that of dispersions made in a GER. However, the liquid behaved as a metallic toner fluid when electrophoretically developed as described in Example 2.

Example 2

Electrophoretic Deposit and Electroless Plating

A 6 micrometer thick substrate of polyethyleneterephthalate (PET) was adhered to a grounded aluminum plate by applying a thin layer of ethanol at the substrate-aluminum interface. The entire assembly was passed through an extrusion type developing station commonly used in liquid toner development using the dispersion of Example 1 as the toner fluid.

Two samples were prepared at different electric potentials. In the first sample, a negative electric potential of −200 volts (V) was applied to the developing station with the PET substrate in contact with the meniscus of the colloidal palladium dispersion to allow the negatively-charged palladium particles to be repelled and driven to the surface of the polymer substrate. A continuous colloidal elemental metal coating the width of the developing station was produced. The PET surface potential after development was measured to be −180 V with respect to the ground plate. Increasing the developing voltage or the development time by slowing the speed of the platform passing the station, produced an increase in surface potential of the coated substrate and a more dense colloidal metal coating on the PET surface. For instance, in sample 2, at −1200 V bias potential, a surface potential of −885 V was generated. However, even at the highest metal loadings, no electrical conductivity could be detected by two probe resistance measurements.

The palladium coatings were metallic grey in appearance. Immersion of the coated substrate samples in a commercial electroless copper plating solution, Cuposit TM 3350 (Shipley Co., Newton, Mass.), at room temperature for 5 minutes produced a shiny metallic copper coating on the palladium-coated surfaces. No copper was deposited on the palladium-free surfaces. A two probe resistance of approximately 10 ohms indicated that the copper plating was electrically conductive. A MacBeth TR 527 densitometer was used to measure the optical density of the plated copper as a means of indirectly gauging the thickness of the copper. Sample 1 had a white light optical density of 1.9, and sample 2 had a white light optical density of 2.7.

Example 3

Preparation of Metallic Toner Fluid

A solution containing one weight percent of FC-740 in Isopar TM G was prepared, and about 0.05 weight percent solid palladium acetate was added to the solution. The mixture was heated to 115° C. for thirty minutes with no apparent reduction of metal occurring (judging from a lack of color change). The temperature was increased to 157° C. Within sixty minutes, the solution had become black. PCS analysis showed the sample to be fairly monodisperse with a mean number average particle size of 91.6 nanometers. The palladium concentration was found to be 150 ppm by ICP Spectroscopy.

Example 4

Electrophoretic Deposit and Electroless Plating

This example was carried out as described in Example 2, except the toner of Example 3 was used. Using a −200 V bias potential on the development station, a −15 V surface potential on the PET substrate was detected as compared to −180 V in sample 1 of Example 2. This difference, however, did not appear to effect the metallic coating's utility in electroless plating. The metal-coated substrate was immersed film in the Cuposit TM 3350 solution for two minutes to produce an electrically-conductive, shiny copper plating on the palladium-coated surface. The resulting plated article had a white light optical density of approximately 3.4.

Example 5

Preparation of Metallic Toner Fluid

This example describes the use of hydrogen to prepare colloidal dispersions from palladium acetate.

Palladium acetate (12.1 mg) was added to 80 ml of a solution Isopar TM G containing 0.04 weight percent OLOA TM 1200 in a 100 ml round bottom flask. The mixture was warmed to 90° C. on a hot plate, while stirring with a magnetic stirrer and bubbling nitrogen into the solution. When the palladium acetate dissolved, a slow stream of hydrogen gas was introduced into the nitrogen stream. Within approximately twenty minutes, the solution had become black. Bubbling was continued for an additional 30 minutes to ensure complete reduction. PCS analysis showed the mean number average particle size to be 21.7±8.3 nm. In the absence of a hydrogen stream, no visible changes occurred when stirred overnight at 90° C.

What is claimed is:

1. A method of making a colloidal palladium and/or platinum metal dispersion that can be used as a toner fluid, which method comprises:

reducing a palladium and/or platinum metal of a metallo-organic palladium and/or platinum metal salt which lacks halide functionally in a dispersing medium comprising an organic carrier liquid and a soluble surfactant, the palladium and/or platinum metal of the metallo-organic metal salt being reduced in the dispersing medium to form colloidal elemental palladium and/or platinum metal particles, the soluble surfactant being present in the dispersing medium in an amount sufficient to charge and stabilize the elemental palladium and/or platinum metal particles as a colloidal metal dispersion.

2. The method of claim 1, wherein the organic carrier liquid has a dielectric constant of less than 3.5.

3. The method of claim 2, wherein the organic carrier liquid has a dielectric constant of less than 2.5.

4. The method of claim 2, wherein the colloidal metal dispersion has a volume resistivity of greater than $10^9$ ohm-cm.

5. The method of claim 4, wherein the colloidal metal dispersion has a volume resistivity of greater than $10^{10}$ ohm-cm.

6. The method of claim 1, wherein the resulting metal particles have sizes in the range of 1 to 250 nanometers.

7. The method of claim 6, wherein the resulting metal particles have sizes in the range of 1 to 100 nanometers.

8. The method of claim 1, wherein the metallo-organic metal salt is introduced into the dispersing medium at 0.001 to 2 weight percent.

9. The method of claim 8, wherein the metallo-organic metal salt is introduced into the dispersing medium at 0.005 to 1 weight percent.

10. The method of claim 1, wherein the metallo-organic metal salt is reduced by heating the dispersing medium, introducing a secondary reducing agent into the dispersing medium, or by a combination thereof.

11. The method of claim 10, wherein the metallo-organic metal salt is reduced by introducing a secondary reducing agent into the dispersing medium.

12. The method of claim 11, wherein the secondary reducing agent is hydrogen gas.

13. The method of claim 10, wherein the palladium and/or platinum metal of the palladium and/or platinum metal salt is reduced by heating the dispersing medium.

14. The method of claim 1, wherein the metallo-organic metal salt is selected from the group consisting of palladium(II) acetate, palladium(II) formate, palladium(II) propionate, palladium(II) fumarate, palladium(II) stearate, palladium(II) benzoate, diacetatobis (triphenylphosphine) palladium(II), platinum(II) acetate, platinum(II) formate, platinum(II) propionate, platinum(II) fumarate, platinum(II) stearate, platinum(II) benzoate, palladium(II) 2,4-pentanedionate, palladium(II) 1,1,1,5,5,5-hexafluoro 2,4-pentanedionate, platinum(II) 2,4-pentanedionate, and platinum(II) 2,4-octanedionate.

15. The method of claim 14, wherein the metal of the metallo-organic metal salt is palladium.

16. The method of claim 15, wherein the metallo-organic metal salt is palladium(II) acetate, or palladium(II) 2,4-pentanedionate.

17. The method of claim 14, wherein the metal of the metallo-organic metal salt is platinum.

18. The method of claim 17, wherein the metallo-organic metal salt is platinum(II) acetate or platinum(II) 2,4-pentanedionate.

19. The method of claim 1, wherein the carrier liquid is a paraffinic hydrocarbon having a dielectric constant less than 3.5 and volume resistivity greater than $10^{12}$ ohm-cm.

20. The method of claim 1, wherein the soluble surfactant is present in the carrier liquid at 0.0001 to 0.01 grams per milliliter and comprises a polyisobutylene having a diamine head group and a succinimide linkage.

21. The method of claim 1, wherein the soluble surfactant is a fluorinated alkyl ester.

22. A method of making a metallic coating, which comprises:

providing a colloidal metal dispersion according to the method of claim 4; and electrophoretically depositing the palladium and/or platinum elemental metal particles onto at least a portion of at least one surface of a primary receiving substrate.

23. A method of making an electrically-conductive metal plating, which comprises:

(a) providing a metallic coating according to the method of claim 22; and (b) contacting the deposited palladium and/or platinum metal particles of the metallic coating of step (a) with an electroless metal plating solution for a time sufficient to provide a metal plating which is electrically conductive.

24. A method of transferring a metal plating, which comprises:

(a) providing a metal plating according to the method of claim 23; and (b) transferring at least a portion of the metal plating from the primary receiving substrate to a secondary receiving substrate.

25. A method of transferring a metallic coating, which comprises:

(a) providing a metallic coating according to the method of claim 22; and (b) transferring at least a portion of the metallic coating from the primary receiving substrate to a secondary receiving substrate.

26. The method of claim 25, further comprising subjecting the secondary receiving substrate to an electroless metal plating solution after transfer of the metallic coating to induce metal plating on the elemental metal coated portions of the secondary receiving substrate so as to provide a metal plating that is electrically conductive.

27. A method of making a metallic toner fluid composition, which method comprises:

introducing a metallo-organic palladium or platinum metal salt which lacks halide functionally or combination thereof into an organic carrier liquid that contains a soluble surfactant and has a dielectric constant less than 3.5 and a volume resistivity greater than $10^{12}$ ohm-cm; and reducing the palladium or platinum metal or combination thereof to form metal particles of elemental palladium, elemental platinum, or elemental combinations thereof having sizes in the range of 1 to 250 nm, the metallo-organic palladium and/or platinum metal salt being reduced to form the palladium and/or platinum elemental metal particles by heating the carrier liquid, and optionally introducing a secondary reducing agent into the carrier liquid, the metal particles of palladium, platinum, or combinations thereof being suspended as colloidal particles in the organic carrier liquid by a soluble surfactant that is present in the organic carrier liquid.

* * * * *

UNITED STATES PATENT AND TRADEMARK OFFICE

CERTIFICATE OF CORRECTION

PATENT NO. : 5,332,646
DATED : July 26, 1994
INVENTOR(S) : Robin E. Wright et al.

It is certified that error appears in the above-indentified patent and that said Letters Patent is hereby corrected as shown below:

Col. 1, line 41, after "size" insert --and--.

Col. 12, line 36, "functionally" should be --functionality--.

Col. 14, line 34, "functionally" should be --functionality--.

Signed and Sealed this

Thirteenth Day of December, 1994

*Attest:*

Bruce Lehman

BRUCE LEHMAN

*Attesting Officer*

*Commissioner of Patents and Trademarks*